US010035057B2

(12) United States Patent
Tillmann, Sr.

(10) Patent No.: US 10,035,057 B2
(45) Date of Patent: Jul. 31, 2018

(54) COMBINATION TRAINING DEVICE AND LACROSSE STICK ASSEMBLY INCLUDING SHOOTING STRINGS AND METHOD

(71) Applicant: Alfred Craig Tillmann, Sr., Baltimore, MD (US)

(72) Inventor: Alfred Craig Tillmann, Sr., Baltimore, MD (US)

( * ) Notice: Subject to any disclaimer, the term of this patent is extended or adjusted under 35 U.S.C. 154(b) by 123 days.

(21) Appl. No.: 14/641,374

(22) Filed: Mar. 7, 2015

(65) Prior Publication Data

US 2016/0256759 A1 Sep. 8, 2016

(51) Int. Cl.

| | |
|---|---|
| ***A63B 69/00*** | (2006.01) |
| ***A63B 60/02*** | (2015.01) |
| ***A63B 59/20*** | (2015.01) |
| *A63B 102/14* | (2015.01) |

(52) U.S. Cl.

CPC ..... *A63B 69/00* (2013.01); *A63B 59/20* (2015.10); *A63B 60/02* (2015.10); *A63B 2102/14* (2015.10); *A63B 2225/68* (2013.01)

(58) Field of Classification Search

CPC . A63B 69/005; A63B 69/00; A63B 2243/005; A63B 59/02

USPC ..... 473/422, 437, 446, 459, 463, 513; D21/753; 482/105

See application file for complete search history.

(56) References Cited

U.S. PATENT DOCUMENTS

| | | | | |
|---|---|---|---|---|
| 891,818 | A * | 6/1908 | Ceel | E05B 63/122 292/116 |
| 2,039,138 | A * | 4/1936 | Auer | A63B 59/02 473/513 |
| 3,169,019 | A * | 2/1965 | Genjack | 473/457 |
| 3,414,260 | A | 12/1968 | Gust | |
| 3,490,768 | A * | 1/1970 | Archer | 473/213 |
| 3,591,178 | A * | 7/1971 | Milligan | A63B 59/02 473/513 |
| 4,671,510 | A | 6/1987 | Schoenwetter | |
| 5,286,021 | A | 2/1994 | Shaw | |
| 5,425,541 | A | 6/1995 | Ambros | |
| 5,964,671 | A | 10/1999 | Edwards et al. | |
| D501,037 | S | 1/2005 | Okamoto | |
| 7,244,200 | B2 | 7/2007 | Goldberg | |

(Continued)

OTHER PUBLICATIONS

Sports Unlimited, 2010 Lacrosse Head Specifications, http://www.sportsunlimitedinc.com/2010-lacrosse-head-specifications.html, captured Mar. 14, 2010.*

(Continued)

*Primary Examiner* — Melba Bumgarner
*Assistant Examiner* — Laura L Davison
(74) *Attorney, Agent, or Firm* — PK Patent Law

(57) ABSTRACT

A training device and method of training for a lacrosse stick assembly are provided. The training device can include a band including a front portion and a back portion. The band can be configured such that a point on the back portion of the band is arranged a distance higher than a point on the front portion. When the band is secured to the head of the lacrosse stick assembly, the back portion of the band is arranged closer to the lip of the head. A weight can be arranged on the back portion of the band and on an exterior side thereof. The weight is configured to be held below the sidewalls of the head at a location in the pocket where a lacrosse ball would sit during actual play when the band is secured to the head.

13 Claims, 6 Drawing Sheets

(56) References Cited

U.S. PATENT DOCUMENTS

| | | | | |
|---|---|---|---|---|
| 7,407,451 | B2 * | 8/2008 | Velasquez | 473/422 |
| 7,662,055 | B2 | 2/2010 | Cutlip | |
| 7,699,723 | B2 | 4/2010 | Herman | |
| D691,227 | S | 10/2013 | Gates | |
| D707,315 | S | 6/2014 | Hall, Jr. et al. | |
| 8,753,232 | B2 | 6/2014 | Edwards | |
| 2004/0063519 | A1 * | 4/2004 | Liberatore | A63B 15/00 473/457 |
| 2004/0176194 | A1 * | 9/2004 | Mitchell | A63B 21/0608 473/437 |
| 2004/0209711 | A1 * | 10/2004 | Liberatore | A63B 15/00 473/457 |
| 2007/0191140 | A1 | 8/2007 | Andrea | |
| 2008/0032829 | A1 | 2/2008 | Andrea et al. | |
| 2008/0058129 | A1 | 3/2008 | Herman | |
| 2009/0253560 | A1 * | 10/2009 | Cook | A63B 21/065 482/105 |
| 2012/0302380 | A1 * | 11/2012 | Erkkinen | 473/437 |
| 2013/0085021 | A1 | 4/2013 | Schoenwetter | |
| 2014/0106909 | A1 | 4/2014 | Thuma | |

OTHER PUBLICATIONS

TommieCopper, Wrist Sleeve Sizing Chart, http://www.tommiecopper.com/mens-sizing-charts/, captured Oct. 1, 2015.*

* cited by examiner

COMBINATION TRAINING DEVICE AND LACROSSE STICK ASSEMBLY INCLUDING SHOOTING STRINGS AND METHOD

FIELD OF THE INVENTION

The present teachings relate to a training device, and in particular, to a weighted training device for use with a lacrosse stick for developing a player's stick skills.

BACKGROUND OF THE INVENTION

Lacrosse is a high-speed and high energy game requiring significant player speed, agility, and stick skills. Players often spend a considerable amount of time and energy training to improve their speed, agility, and stick skills. In addition, player strength also plays a fundamental role in their performance. As a result, there are known devices for adding weight (such as a simulated ball) to a lacrosse stick as a training or warm-up aid to improve strength, act as a stretching routine, and improve agility. These known devices operate to work the shoulder, arm, and hand muscles that are used by athletes when playing lacrosse.

Known training devices are designed to add weight to the sidewalls of the head or to the base (throat) of the lacrosse stick. Other known training devices involve adding weight to the shaft, the throat, or the sidewalls of the head of the lacrosse stick. Still other known training devices do not directly secure a weight within the pocket and instead use a tether arrangement. With these known training devices, however, the weight of the device is not situated in the true pocket position of the head of the lacrosse stick where a lacrosse ball would actually sit during play. Rather than residing in the pocket, the weight is held at the throat, sidewalls, or shaft of the lacrosse stick.

Accordingly, there exists a need for a training device that holds a weight at the specific point of a lacrosse stick head pocket that corresponds to where a ball would sit during actual play. Such a training device would allow players to exercise the same muscles used as if they were handling a real ball and provide a feel to the stick as if an actual ball were residing in the pocket.

SUMMARY OF THE INVENTION

The present teachings provide a training device including a band having a front portion and a back portion and being capable of being secured to a head of a lacrosse stick. The training device can include a weight being operatively arranged with the back portion of the band. The back portion of the band is arranged offset from the front portion of the band such that the weight is capable of being held closer to a distal end of the head of the lacrosse stick with respect to the front portion of the band when the band is secured to the head of the lacrosse stick.

The present teachings also provide a training device for a lacrosse stick assembly including a head having angled sidewalls, a mesh forming a pocket, and a lip at a distal end thereof. The training device includes a band including a front portion and a back portion and having a width. The band is configured such that a point at a mid-point of the width at the back portion of the band is arranged an offset distance higher than a point at the mid-point of the width on the front portion such that when the band is secured to the head of the lacrosse stick assembly, the back portion of the band is arranged closer to the lip of the head compared to the front portion of the band. The training device includes a weight arranged on the back portion of the band and on an exterior side thereof. The weight is configured to be held by the band below the sidewalls of the head at a location in the pocket where a lacrosse ball would sit during actual play when the band is secured to the head.

The present teachings still further provide a method of training with a lacrosse stick including a head having angled sidewalls, a mesh forming a pocket, and a lip at a distal end thereof. The method includes providing a band including a front portion and a back portion, the back portion of the band being arranged offset with respect to the front portion of the band. The method also includes providing a weight on the back portion of the band. The method still further includes securing the band to the angled sidewalls of the head of the lacrosse stick using a friction fit such that the weight is held below the sidewalls and closer to the lip of the head compared to the front portion of the band corresponding to a location in the pocket where a lacrosse ball would sit during actual play.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings relate to a lacrosse stick training device 100 including a weighted band that can be used for practice, stretching, or training to help develop a lacrosse player's stick skills More specifically, the present teachings relate to a shaped band including a weighted portion that can secure without fasteners to a head of a lacrosse stick. The band can be shaped so that the weighted portion can be held in the area of the pocket of the head of the lacrosse stick where an actual lacrosse ball would reside during play. When a player secures the training device 100 to a lacrosse stick it allows him or her to exercise the same muscles used as if handling a real ball and allows them to develop a feel for where a ball sits in the pocket.

Figure 5:
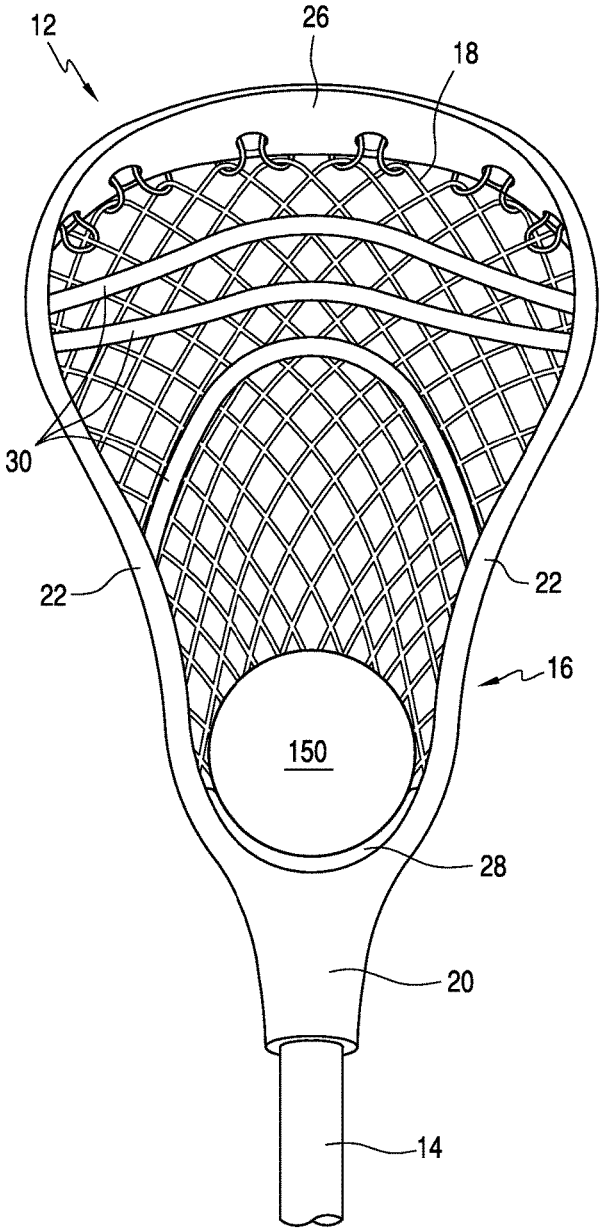
FIG. 5 PRIOR ART
FIG. 5 shows a front view of a known regulation men's lacrosse stick assembly with a lacrosse ball held in a lower portion of the pocket.
Figure 6:
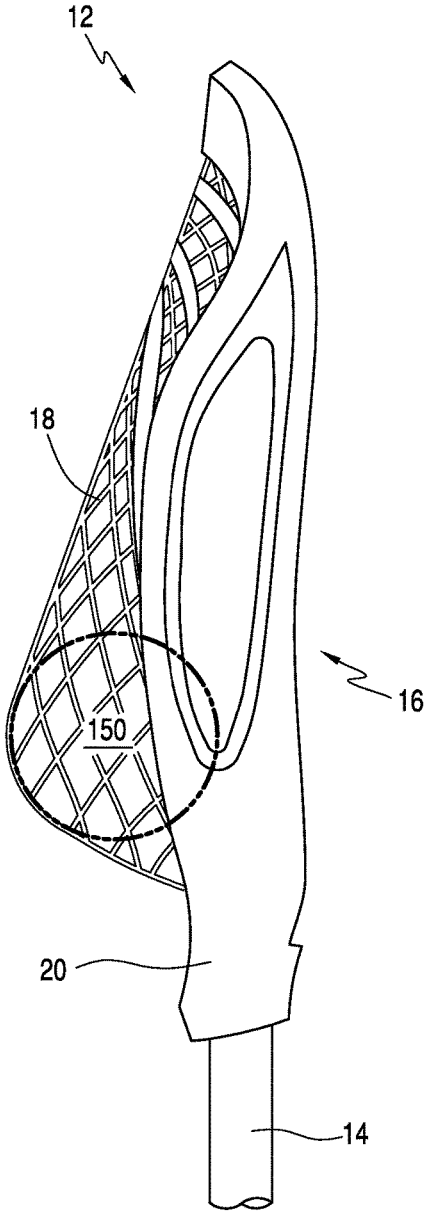
FIG. 6 PRIOR ART
FIG. 6 shows a side view of the men's lacrosse stick assembly of FIG. 5.

FIGS. 1-4 show the lacrosse stick training device 100 according to an embodiment of the present teachings. The training device 100 is intended for use with any lacrosse stick assembly 12. Referring to FIGS. 5 and 6, a typical lacrosse stick assembly 12 includes a shaft or stick 14, a head 16, and a mesh 18 that secures to the head 16. The mesh 18 defines a pocket for holding a lacrosse ball 150. FIGS. 5 and 6 show the lacrosse ball 150 being held in a lower portion of the pocket but the ball 150 can be held in other parts of the pocket depending on how the lacrosse stick 12 is being handled by a player. The mesh 18 can include shooting strings 30 that are formed in an upper portion of the pocket. The head 16 can include a throat or neck 20, a pair of sidewalls 22, and a lip or scoop 26. A stopper 28 can be arranged at the throat or neck 20.

During play, when a player is dodging defenders or otherwise running with a ball 150 in the lacrosse stick assembly 12, the ball 150 will generally sit in a lower portion of the pocket of the head 16, as shown in FIGS. 5 and 6. In some situations, the ball 150 can rest against the stopper 28 situated at the throat 20.

Figure 7:
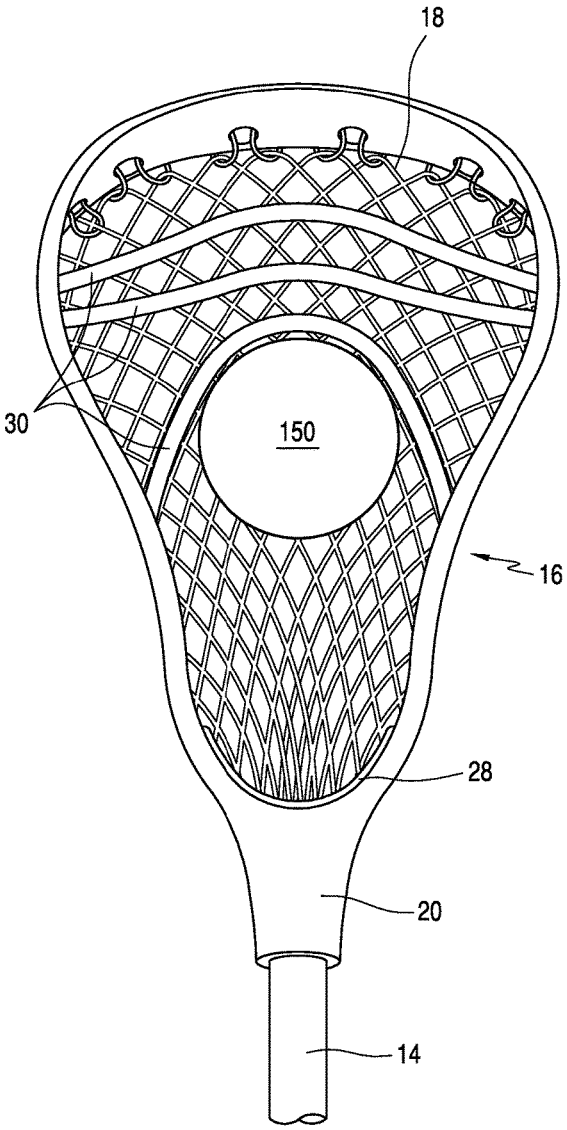
FIG. 7 PRIOR ART
FIG. 7 shows a front view of a known regulation men's lacrosse stick assembly with a lacrosse ball held in an upper portion of the pocket corresponding to a shooting position.
Figure 8:
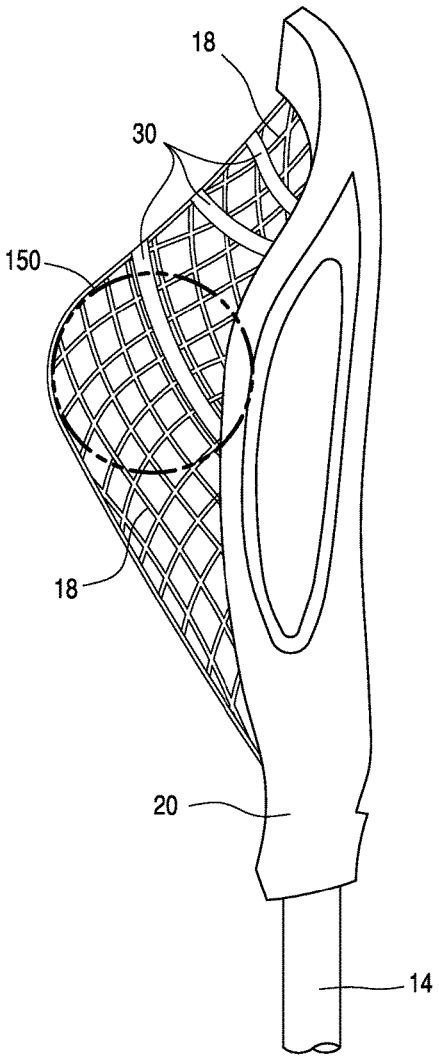
FIG. 8 PRIOR ART
FIG. 8 shows a side view of the men's lacrosse stick assembly of FIG. 7.

When a player is preparing to pass or shoot, he or she will generally cradle the stick 14 thereby creating forces which move the ball 150 upwardly within the pocket of the head 16 into a shooting position, as shown in FIGS. 7 and 8. The shooting position of the ball 150 corresponds to a position just below the shooting strings 30. Then, when the player decides to pass or shoot the ball 150, the distal end of the stick 14 is forced to move forwardly so that the ball 150 is released off of the shooting strings 30 in the upper portion of the pocket.

The lacrosse stick training device 100 of the present teachings provides a removable weight system that simulates the feel of a lacrosse ball near the shooting strings 30 just as in real play when cradling, shooting, and passing. The lacrosse stick training device 100 operates to hold a weight in an area corresponding to the upper portion of the pocket where the lacrosse ball would reside when in the shooting and passing positions or when the stick 14 is being cradled.

Referring to FIGS. 1-4, the lacrosse stick training device 100 of the present teachings includes a band 50 and a weight 90. The band 50 can be made of any elastomeric material, such as rubber, silicone, and the like. The band 50 can be formed from a continuous length of material having a width, W. The band 50 can include two ends 52, 54 that can come together at a joint area 56 to form a continuous loop or ring. Alternatively, the band 50 can be formed as a unitary ring without a connection joint. As will be discussed in more detail below, the weight 90 can be arranged on the band 50 via a connection mechanism 80 in the vicinity of where the band ends 52, 54 meet.

The band 50 can have a relatively large width, W, so as to provide a secure friction fit along the widening portion of the head 16 (where the sidewalls 22 of the head 16 angle outwardly) of the lacrosse stick assembly 12. For example, the width of the band 50 can be from 1.50 to 4.00 inches, and preferably, about 2.50 inches (which is substantially equal to the diameter of a regulation lacrosse ball 150). According to an embodiment, the width of the band 50 can vary about its circumference. Moreover, the band 50 can have a thickness that can affect the friction fit between the band 50 and the head 16. For example, the thickness of the band 50 can be from 0.0625 inches to 0.25 inches, and preferably, about 0.125 inches. According to an embodiment, the thickness of the band 50 can vary about its circumference. While the band 50 is shown as being a continuous ring or loop, the band 50 could be formed as a discontinuous loop that can secure onto the head 16. For example, the band 50 could form a C-shape having an opening on one side, such as the front side. The band 50 could be formed of a non-elastic material that can secure to the head 16.

Figure 3:
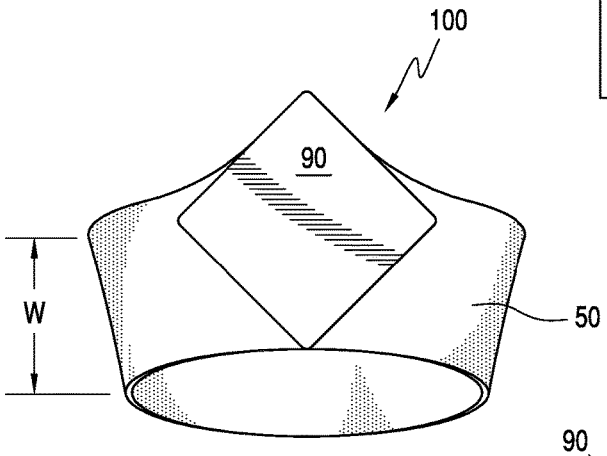
FIG. 3 shows a back view of the lacrosse stick training device of FIG. 1.
Figure 4:
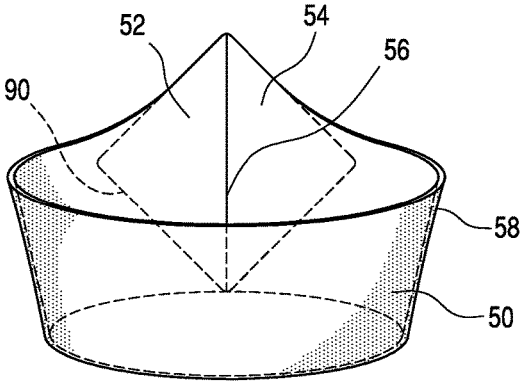
FIG. 4 shows a front view of the lacrosse stick training device of FIG. 1.

As best shown in FIGS. 3 and 4, at least a portion of the band 50 can be formed to include outwardly angled or flared walls 58. The outwardly flared shape of the walls 58 can generally correspond to the angled shape of the sidewalls 22 of the head 16 of the lacrosse stick 12. The outwardly flared walls 58 of the band 50 can help achieve a friction fit between the band 50 and the head 16. The shape of the flared walls 58 can be achieved in a variety of ways. For example, as shown in FIG. 4, each of the ends 52, 54 of the band 50 can be cut at a substantially equal angle and then secured together by butting the ends together at joint 56. According to an alternative embodiment, each of the ends 52, 54 of the band can be overlapped and secured together at an angle at the overlap to form the loop thereby creating the outwardly flared walls 58. According to yet another alternative embodiment, the band 50 can be formed as a unitary structure having integrally formed flared walls 58 and without a connection joint, by way of, for example, a molding process.

Figure 1:
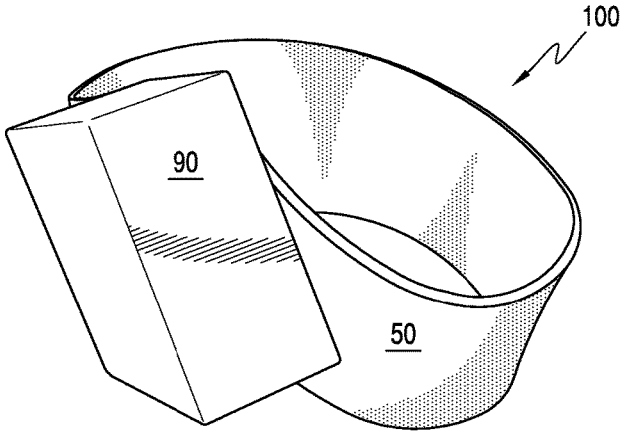
FIG. 1 shows a perspective view of the lacrosse stick training device of the present teachings.
Figure 2:
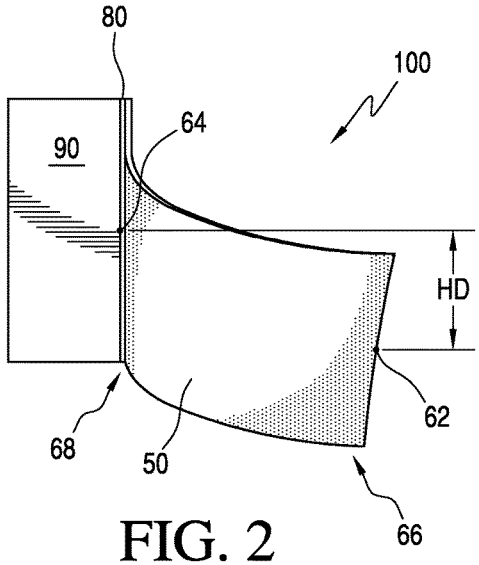
FIG. 2 shows a side view of the lacrosse stick training device of FIG. 1.

As best shown in FIG. 2, the shape of the band 50 results in one side of the band extending higher than an opposite side. For example, a point 64 corresponding to the center or mid-point of the width at a back portion 68 of the band 50 is shown a distance, HD, higher than a point 62 corresponding to the center or mid-point of the width at the front portion 66 of the band 50. This height difference or offset, HD, can be varied by changing the angle of connection between the ends 52, 54 of the band 50. For example, to increase the height difference, HD, between the front and back portions of the band 50, the angle of connection between the ends 52, 54 of the band 50 is increased. According to various embodiments, the height difference or offset, HD, between the front and back portions of the band 50 of the band can be from about 0.5 inches to about 3 inches, and preferably, about 2 inches. The variation in this height difference, HD, can be attributed to the fact that some players like "high pockets" (greater HD making the weight 90 closer to the lip 26 of the head 26), and some players like a "low pocket".

The weight 90 can be arranged on the band 50 on the upwardly extending back portion 68. The weight 90 can be arranged on the band 50 via any type of connection mechanism 80. In an exemplary embodiment, the weight 90 can be arranged on an exterior side of the band 50. However, the weight 90 could be arranged on an interior side of the band 50 as discussed below in connection with use with a women's lacrosse stick. By holding the weight 90 on the upwardly extending back portion 68 of the band 50 and on the exterior side thereof, the lacrosse stick training device 100 of the present teachings simulates a lacrosse ball being held in the upper portion of the pocket of the head 16 as would occur during cradling, shooting, and passing.

In an embodiment where the band 50 is formed from a non-resilient material, the height difference or offset, HD, can be achieved by the band 50 including an extension that extends upwardly at the back portion 68 of the band. The extension can form gradually along the back portion of the band 50 or can extend abruptly upwardly to achieve the height difference, HD. The weight 90 can be arranged on this extension so as to achieve the feel of a lacrosse ball being held in the upper portion of the pocket.

The weight 90 can have a variety of shapes and sizes. For example, the weight 90 can form a generally square or diamond shape, as shown in FIGS. 1-4. The weight 90 can have a dimension that approximates the width of the band 50 as shown, or can have a dimension that is smaller or bigger than the width of the band 50. In an exemplary embodiment, the weight 90 can be attached to the band so it is arranged symmetrically about the point 64 corresponding to the center of the width of the back portion 68 thereof. According to another embodiment, the weight 90 can be arranged anywhere along the width of the back portion 68 of the band 50.

The weight 90 can approximate the weight of a standard lacrosse ball, although other weights can be used. For example, if muscle-training is desired, the weight 90 can weigh more than a standard lacrosse ball. The weight of an NCAA lacrosse ball can be between about 140*g* and about 147*g*. As a result, the range of the weight 90 can be from about 140*g* (corresponding to 1 ball) to about 441*g* (corresponding to an upper limit of 3 balls). According to an exemplary embodiment, the weight 90 can be about 294*g* (corresponding to an upper limit of 2 balls). The weight 90 can be arranged to increase in steps corresponding to the weight of 1 ball, 1.5 balls, 2 balls, and so on.

A weight 90 can be releasably secured to the band 50 via the connection mechanism 80 or formed as one-piece with the band 50. One or more weights 90 can be detachably secured to the band 50 via the connection mechanism 80. As training progresses, the band 50 or the weight 90 can be designed to accept supplemental weights as desired.

The weight 90 can attach to the band 50 in various ways via the connection mechanism 80. For example, a weight 90 can slide into a region of the band 50 or into a region formed in another weight. Furthermore, a first weight 90 of a series of weights can be designed with one or more apertured regions to accept one or more supplemental weights. According to another embodiment, the weight 90 can lock or snap into the band 50 via the connection mechanism 80.

Figure 9:
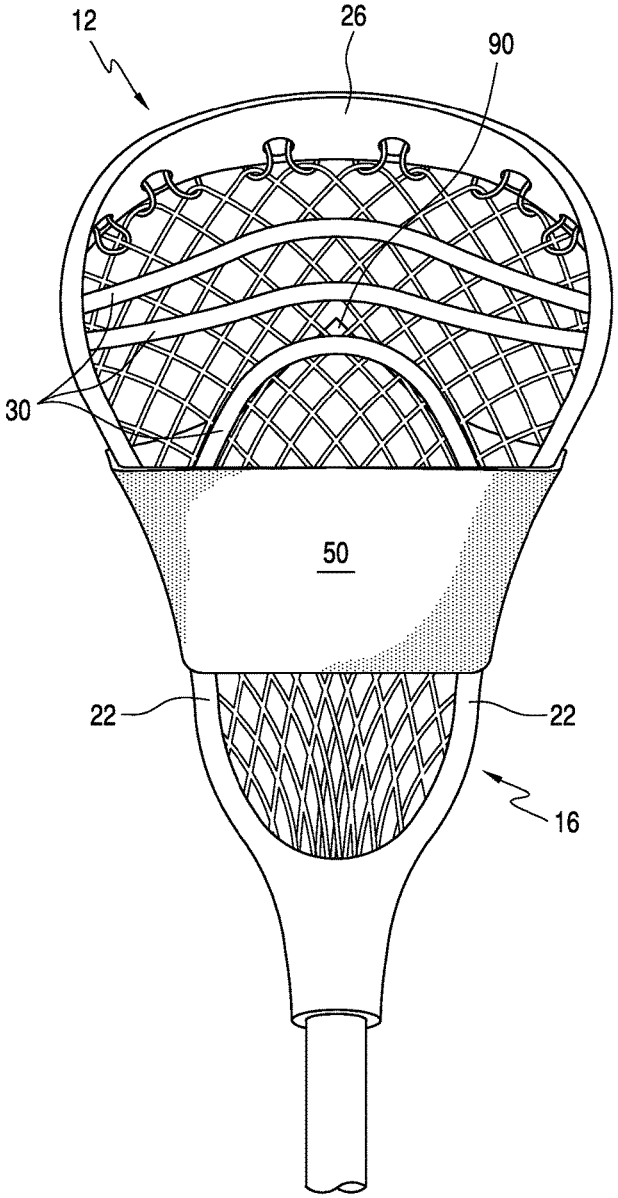
FIG. 9 shows a front view of a known regulation men's lacrosse stick assembly with the lacrosse stick training device of the present teachings secured thereto.
Figure 10:
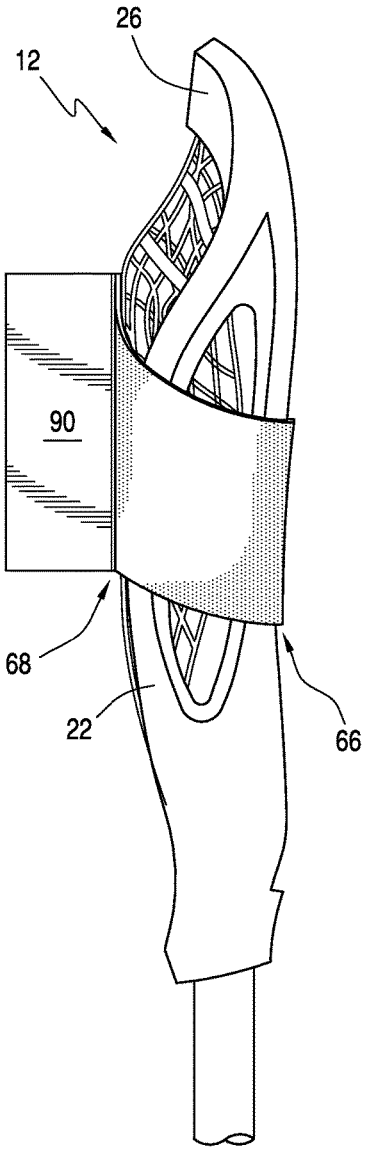
FIG. 10 shows a side view of the men's lacrosse stick assembly of FIG. 9.
Figure 11:
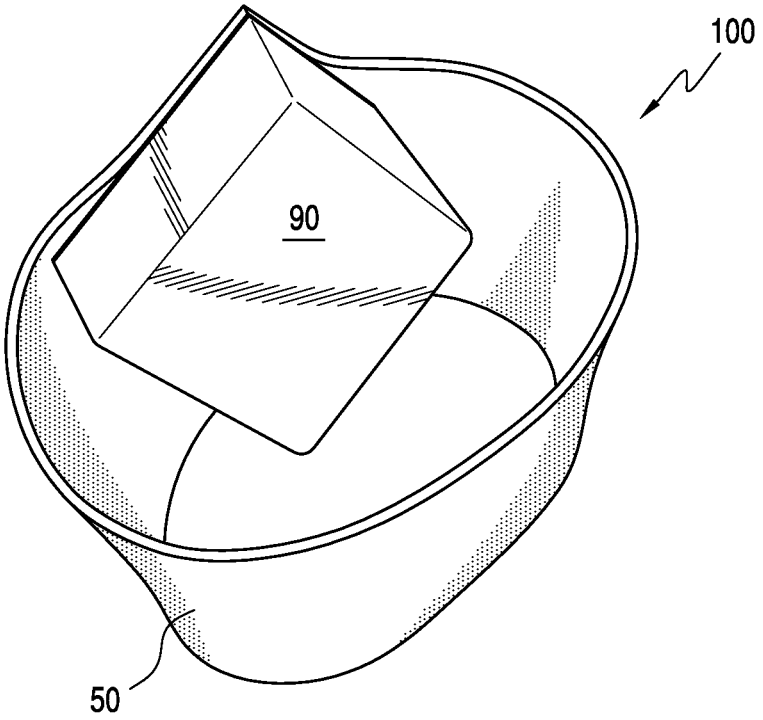
FIG. 11 shows a perspective view of a lacrosse stick training device of the present teachings adapted for use with a women's lacrosse stick.

When securing the training device 100 of the present teachings to a lacrosse stick assembly 12, the shape of the band 50 allows the stick 14 and throat 22 of any lacrosse stick assembly 12 to slide into an interior of the band 50. The training device 100 can then be slid upwardly until the interior surfaces of the walls 58 of the band 50 meet the angled sidewalls 22 of the lacrosse head 16, as shown in FIGS. 9 and 10. The features of the band 50 as described above ensure a snug frictional fit between the training device 100 of the present teachings and any lacrosse head 16. This frictional fit also ensures that the training device 100 will not release upon encountering the forces normally associated with the cradling a lacrosse stick, such as shooting, or any other motions associated with playing lacrosse, such as dodging.

As shown in FIGS. 9 and 10, by having one side of the band (e.g. the back portion 68) extend higher than an opposite side (e.g. the front portion 66), the weight 90 is held in a position further along the length of the lacrosse stick assembly 12, that is, in a location closer to a distal end of the head 16 (i.e. closer to the lip 26 of the head 16). At the same time, securing the weight 90 on the exterior of the band 50 allows the weight 90 to be held deeper within the pocket of the head 16. The design of the training device 100 of the present teachings results in the training weight 90 being held near the shooting strings 30 and below the sidewalls 22 of the head 16 of any lacrosse stick assembly 12. This allows the weight 90 to be held at the specific point of the pocket where a lacrosse ball 150 would sit during actual play. By fully simulating a lacrosse ball 150 in the pocket of a head 16, the lacrosse stick training device 100 of the present teachings allows players to exercise the same muscles used as if handling a real lacrosse ball 150 and allow them to develop a feel for where the ball sits in the pocket.

Figure 14:
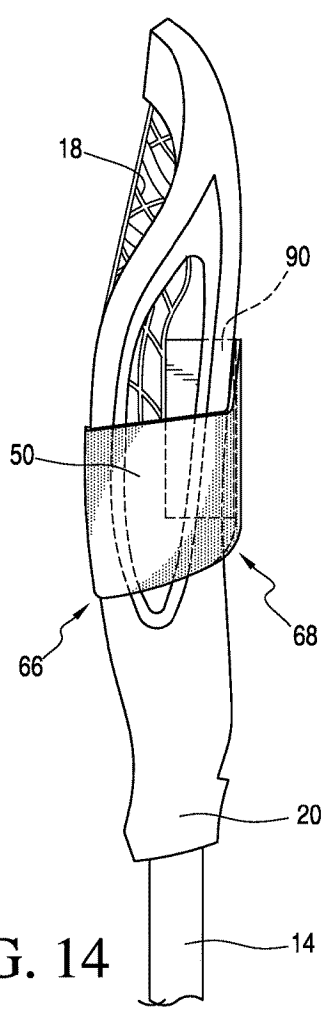
FIG. 14 shows a side view of the women's lacrosse stick assembly of FIG. 12 with the lacrosse stick training device of the present teachings secured thereto.
Figure 13:
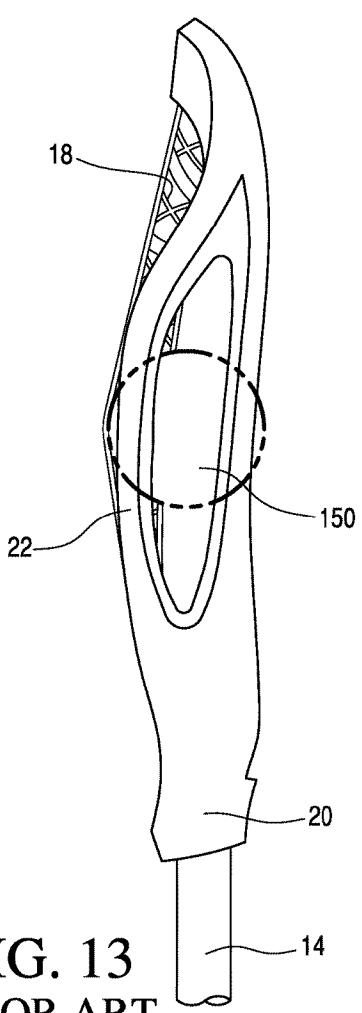
FIG. 13 PRIOR ART
FIG. 13 shows a side view of the women's lacrosse stick assembly of FIG. 12 with a lacrosse ball held in the pocket corresponding to a shooting position.
Figure 12:
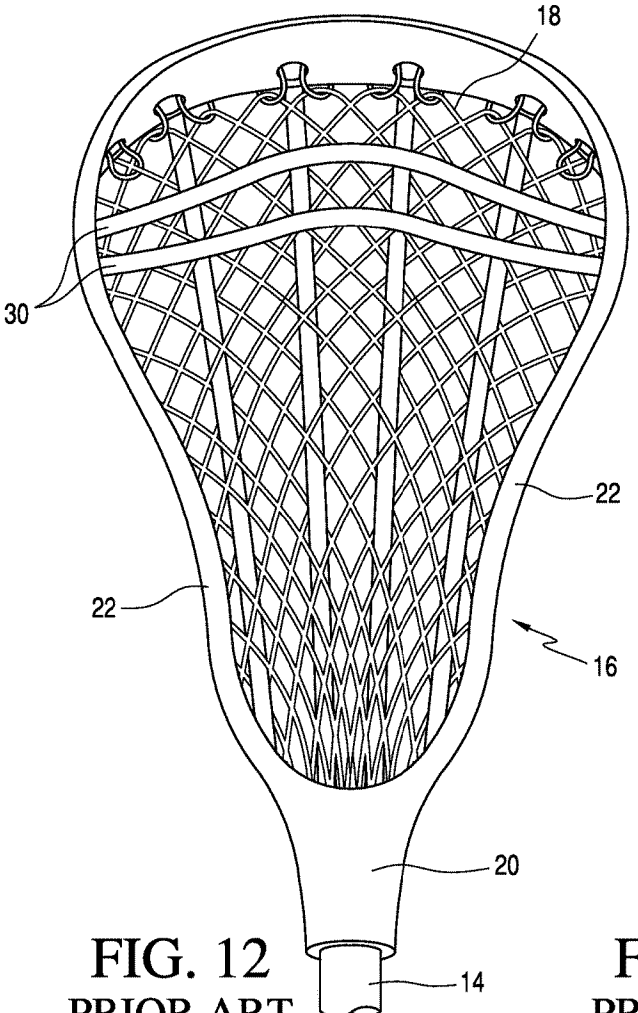
FIG. 12 PRIOR ART
FIG. 12 shows a front view of a known regulation women's lacrosse stick assembly.

Referring now to FIGS. 11-14, the lacrosse stick training device 100 of the present teachings can be adapted for a women's lacrosse stick head 16. According to women's lacrosse rules, the lacrosse stick head 16 has virtually no pocket. As best shown in FIGS. 13 and 14, the mesh 18 defining the pocket of a women's stick is tight and substantially does not sag below the sidewalls 22 of the head 16. As a result, the ball 150 sits directly in between the sidewalls 22 of the head 16 of a women's stick. By turning the lacrosse stick training device 100 inside out (or positioning the weight 90 on the interior of the band 50 rather than on the exterior of the band 50), the weight 90 will simulate the position of the ball 150 being located at the throwing strings 30 and in between the sidewalls 22. Thus, the design of the lacrosse stick training device 100 of the present teachings can generally be used for both men's and women's lacrosse sticks.

While FIG. 14 shows the lacrosse stick training device 100 installed on a women's stick with the upwardly extending back portion 68 of the band 50 (i.e. the end that supports the weight 90) arranged on a front portion of the head 16, it would also be possible to install the training device 100 on a women's stick such that the upwardly extending back portion 68 is arranged on a back portion of the head 16. In this position, the weight 90 can also simulate the position of the ball 150 at the throwing strings 30 and in between the sidewalls 22 of the women's head 16.

The lacrosse stick training device 100 of the present teachings can be used with any sports equipment having a head. While use with a lacrosse stick is disclosed above, device of the present teachings can be used with other equipment having an open head frame, e.g., tennis, racquetball, or badminton racquets, are contemplated and within the scope of the invention. The lacrosse head can be a man's or boy's lacrosse head, where the base of the lacrosse head is "v"-shaped. Alternatively, the lacrosse head may be a woman's or girl's lacrosse head where the base of the lacrosse head is "u"-shaped.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A combination of a training device and a lacrosse stick assembly comprising:

the lacrosse stick assembly including a head having a front side, a back side, angled sidewalls defining a lower head portion, a mesh forming a pocket including a lower portion and an upper portion on the back side and the mesh including shooting strings formed in the upper portion of the pocket such that a ball is capable of being held in the upper portion of the pocket near the shooting strings when the ball is in a shooting position, and a lip at a distal end thereof defining an upper head portion;

the training device including:

a ring-shaped band having a width, an interior surface, and including a front portion and a back portion, the ring-shaped band being shaped such that a point at a mid-point of the width at the back portion of the band is arranged an offset distance higher than a point at the mid-point of the width on the front portion; and a weight arranged on the back portion of the ring-shaped band and on an exterior side thereof;

wherein the ring-shaped band is securable solely to the head at the lower head portion thereof by way of a friction fit between the interior surface of the ring-shaped band and the angled sidewalls of the head;

wherein the back portion of the ring-shaped band is arranged on the back side of the head of the lacrosse stick assembly such that the back portion of the band is arranged closer to the lip of the head compared to the front portion of the band; and wherein the weight is held by the ring-shaped band near the shooting strings and below the sidewalls of the head when the head is horizontally oriented at a location corresponding to the shooting position where a lacrosse ball would sit in the upper portion of the pocket during actual play while cradling, shooting, and passing when the interior surface of the ring-shaped band is secured to the head.

2. The combination of claim 1, wherein the band includes outwardly flared walls generally corresponding to the angled sidewalls of the head of the lacrosse stick assembly.

3. The combination of claim 2, wherein the outwardly flared walls of the band are formed by securing a first end of the band to a second end of the band at an angle at the back portion of the band.

4. The combination of claim 3, wherein the offset distance between the back portion of the band and the front portion of the band can be varied by changing the angle of connection between the first and second ends of the band.

5. The combination of claim 1, wherein the ring-shaped band forms a continuous loop.

6. The combination of claim 1, wherein the offset distance between the mid-point of the back portion of the band and the midpoint of the front portion of the band is from about 0.5 inches to about 3 inches.

7. The combination of claim 1, wherein the weight is statically arranged on the band in a manner such that the weight does not to move with respect to the band when the lacrosse stick assembly is cradled.

8. The combination of claim 1, wherein the weight is held by the ring-shaped band below the shooting strings at the location corresponding to the shooting position where a lacrosse ball would sit in the upper portion of the pocket during actual play while cradling, shooting, and passing when the interior surface of the ring-shaped band is secured to the head.

9. A method of training with a lacrosse stick assembly including a head having a neck at a proximal end thereof, a front side, a back side, angled sidewalls defining a lower head portion, a mesh forming a pocket including a lower portion and an upper portion on the back side and the mesh including shooting strings formed in the upper portion of the pocket such that a ball is capable of being held in the upper portion of the pocket near the shooting strings when the ball is in a shooting position, and a lip at a distal end thereof defining an upper head portion comprising:

providing a ring-shaped band having an interior surface and including a front portion and a back portion, the back portion of the band being arranged with an offset with respect to the front portion of the band;

providing a weight on the back portion of the band; and securing the interior surface of the ring-shaped band solely to the head of the lacrosse stick assembly using a friction fit between the interior surface of the ring-shaped band and the angled sidewalls of the lower head portion such that (A.) the back portion of the ring-shaped band is arranged on the back side of the head of the lacrosse stick assembly, and (B.) the weight is held (i) closer to the lip of the head compared to the front portion of the band and (ii) near the shooting strings in a location corresponding to the shooting position where a lacrosse ball would sit in the upper portion of the pocket during actual play while cradling, shooting, and passing.

10. The method of claim 9, wherein the offset between the back portion of the band and the front portion of the band is from about 0.5 inches to about 3 inches.

11. The method of claim 9, wherein the band includes a width and a point at a mid-point of the width at the back portion of the band is arranged a distance higher with respect to a point at the mid-point of the width on the front portion such that when the band is secured to the head of the lacrosse stick, the back portion of the band is arranged closer to the lip of the head compared to the front portion of the band.

12. The method of claim 9, wherein the weight is statically arranged on the band in a manner such that the weight does not to move with respect to the band when the lacrosse stick assembly is cradled during training.

13. The method of claim 9, wherein the weight is held below the shooting strings at the location corresponding to the shooting position where a lacrosse ball would sit in the upper portion of the pocket during actual play while cradling, shooting, and passing.

* * * * *